United States Patent [19]

Szadkowski

[11] 4,344,550

[45] Aug. 17, 1982

[54] SELF-ADJUSTING ARRANGEMENT FOR REFRACTORY PLATES OF SLIDE GATE MECHANISM

[75] Inventor: Stanislav Szadkowski, Brussels, Belgium

[73] Assignee: Vesuvius International Corporation, Wilmington, Del.

[21] Appl. No.: 166,203

[22] Filed: Jul. 7, 1980

[30] Foreign Application Priority Data

Jul. 17, 1979 [GB] United Kingdom ..... 7924902

[51] Int. Cl.[3] ..... B22D 41/08

[52] U.S. Cl. ..... 222/600; 251/86

[58] Field of Search ..... 222/598, 600, 512, 561; 251/86, 326

[56] References Cited

U.S. PATENT DOCUMENTS 3,764,042 10/1973 Shapland et al. ..... 222/600 X 3,765,579 10/1973 Cramer et al. ..... 222/600

*Primary Examiner*—David A. Scherbel

*Attorney, Agent, or Firm*—Sughrue, Mion, Zinn, Macpeak and Seas

[57] ABSTRACT

An arrangement for supporting a refractory plate in the supporting frame of a slide gate for a pouring vessel, whereby the refractory plate is able to oscillate with respect to the supporting frame so as to have its position adjustable to the position of the outlet parts of the pouring system. The refractory plate is shaped with at least one sliding surface on its bottom, on its lower lateral edges or on its lower periphery and, in use, this sliding surface bears on a cooperating sliding surface provided on the supporting frame to allow the refractory plate to freely oscillate with respect to the supporting frame.

10 Claims, 6 Drawing Figures

SELF-ADJUSTING ARRANGEMENT FOR REFRACTORY PLATES OF SLIDE GATE MECHANISM

SUBJECT MATTER OF THE INVENTION

This invention relates to improvements in the supporting of refractory plates at the outlet of a bottom-pour vessel, and more particularly to an improved arrangement for supporting a refractory plate in the supporting frame of a slide gate for such pouring vessel, whereby the refractory plate is able to oscillate with respect to the supporting frame, so as to have its position adjustable to the position of the outlet parts of the pouring system.

BACKGROUND OF THE INVENTION

Slide gate mechanisms for moving refractory plates in front of the outlet of a metal-pour vessel, for controlling the pouring of the molten metal therethrough, are generally known in the art, such as for instance from U.S. Pat. Nos. 3,352,465, 3,685,705, 3,709,411 and 3,730,401, French Pat. No. 2,011,140, Luxemburg Pat. No. 37,533 and Belgian Pat. Nos. 871,958, 871,959 and 874,902.

There are already known, on the other hand, provisions for allowing the refractory plate to oscillate with respect to the supporting frame of such mechanisms, in order to allow the refractory plate to adjust its position to the position of the outlet parts of the pouring system, so as to provide a close and tight contact between said refractory plate of the slide gate and said outlet.

There are thus for instance known arrangements in which the refractory plate is hinged on pivots in the supporting frame of the slide gate, as disclosed in particular in French Pat. No. 2,011,140 and in Belgian Pat. Nos. 871,958 and 871,959.

Such known provisions for allowing the oscillation of the refractory plate in the supporting frame are however not entirely satisfactory, in view of the fact that the supporting forces for the refractory plate act on practically punctual bearings points, located at remote places of the plate.

Owing to the considerable forces acting on the middle of the plate, during use, this provision for supporting the refractory plates indeed results in a substantial risk of breaking the refractory plates.

There has now been found a new arrangement for supporting a refractory plate in the supporting frame of a slide gate, which new arrangement allows the free oscillation of the refractory plate with respect to the supporting frame, and at the same time provides a reliable supporting of the refractory plate under all working conditions, thereby avoiding certain risks of breaking of the refractory plates.

SUMMARY OF THE INVENTION

In the improved arrangement, according to the invention, for supporting a refractory plate in the supporting frame of a slide gate, the refractory plate is therefor shaped with at least one sliding surface on the bottom surface, on lower lateral edges or on the lower periphery of said refractory plate, and, in use, bears with said sliding surface of the refractory plate on a cooperating sliding surface provided on said supporting frame, so as to allow the refractory plate to freely oscillate with respect to said supporting frame.

According to one embodiment of the invention the refractory plate may in particular be shaped with sliding surfaces provided along parallel lateral edges of the bottom side of said refractory plate cooperating with sliding surfaces on parallel edges of the supporting frame, so as to provide a bearing which allows the free oscillation of the refractory plate according to a biaxial movement perpendicular to the longitudinal direction of said bearing.

In such embodiment of the invention the longitudinal axis of said oscillation bearing may be provided either parallel to the moving direction of the slide gate or perpendicular to said moving direction, depending on whether in the specifically considered construction the adjustment of the position of the refractory plate should most appropriately perform respectively according to a biaxial oscillation movement perpendicular to the moving direction of the slide gate or according to a biaxial oscillation movement parallel to the moving direction of the slide gate.

According to another feature of this invention, the refractory plate may be supported in such manner that it is able to freely oscillate in all directions.

This latter feature of the invention constitutes a further advantage thereof over the known art, as indeed in the known provisions for supporting a refractory plate in an oscillating manner, such oscillation can only be performed around one axis, this only allowing the adjustment of the position of the refractory plate according to one direction.

Specific embodiments of the invention including this feature of the invention provide a refractory plate which is shaped with at least one sliding surface cooperating with a sliding surface of the supporting frame so as to provide a ball-joint bearing, which allows the refractory plate to freely oscillate in all directions.

According to further embodiments of the invention the sliding surface of the refractory plate may in particular consist of a cylinder or sphere sectors, or may consist of supporting areas, such as convex surfaces, arranged according to a circumscribed cylinder sphere surface.

In such embodiments of the invention the sliding surface of the supporting frame may in particular consist of a corresponding cylinder or sphere sectors, but may also consist of flat surfaces provided at appropriate places with respect to the sliding surface of the refractory plate.

According to still another embodiment of the invention, the sliding surfaces of the refractory plate consist of flat surfaces cooperating with convex surfaces of the supporting frame.

Such embodiment may for instance comprise two or three inclined surfaces, provided according to a diedron or triedron at the bottom side of the refractory plate, cooperating with two or three convex surfaces, suitably provided to the supporting frame, so as to allow the free oscillation of the refractory plate according to a biaxial direction or according to all directions.

According to another feature of the invention, the refractory plate may be provided with a steel envelope, protecting the lateral sides and/or the the bottom side of said refractory plate.

In such case the sliding surface of the refractory plate may preferably consist of a portion of, or be provided on said steel envelope.

BRIEF DESCRIPTION OF THE DRAWINGS

In the drawings.

In these figures like reference numerals designate corresponding parts.

DETAILED DESCRIPTION OF THE PREFERRED EMBODIMENTS

Figure 1:
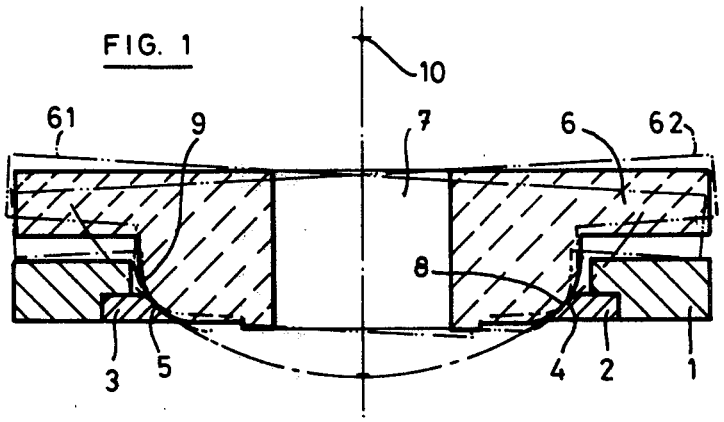
FIG. 1 is a section view of one embodiment of a supporting arrangement for a refractory plate, according to the invention.
Figure 2:
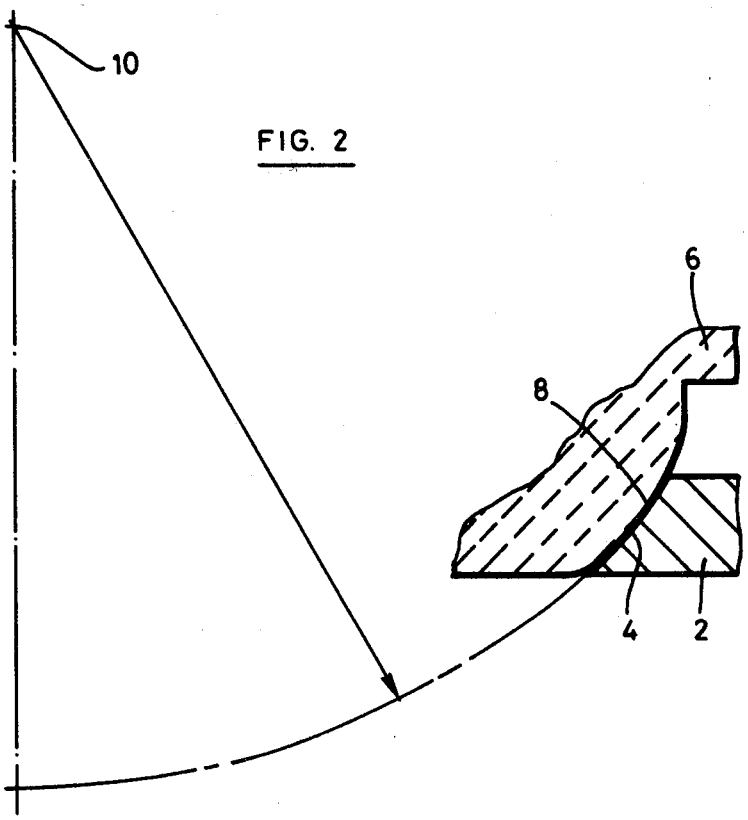
FIG. 2 is an enlarged section view of a pair of cooperating sliding surfaces, of the arrangement according to FIG. 1.

The supporting arrangement shown in FIG. 1 involves a supporting frame 1, provided with supporting beams 2,3 having cylindrical sliding surfaces 4,5 having a common axis 10.

A refractory plate 6 having a pouring aperture 7 bears upon these sliding surfaces 4,5 through cylindrical sliding surfaces 8,9 having an axis 10, which is also the common axis of the cylindrical sliding surfaces 4,5.

During the movement of the slide gate in front of the outlet plate of a pouring vessel (not represented) the refractory plate 6 is able to oscillate on its support so as to adjust its inclination to the lower surface of the outlet plate and so provide a close and tight contact between said outlet plate and the refractory plate 6 of the slide gate.

The oscillation positions of the refractory plate 6 designated by the reference numerals 61 and 62 are shown in dotted lines in FIG. 1.

Figure 4:
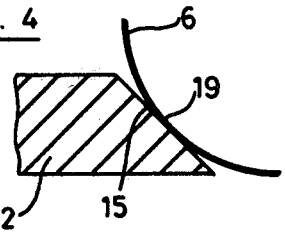
FIGS. 4 and 5 are section views of two further embodiments of pairs of sliding surfaces for arrangements according to the invention, comparable to the arrangement of FIG. 1.
Figure 5:
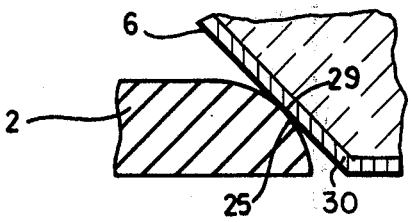

Modified shapes of the sliding surfaces 5,9 of the embodiment of the supporting arrangement shown in FIG. 1 are represented in FIGS. 4 and 5.

FIG. 4 shows an embodiment in which the refractory plate 6 bears on flat surfaces 15 (14) of the supporting beams 3 (2) by means of cylindrical surfaces 19 (18).

The refractory plate may thus, also in this embodiment, be able to oscillate with respect to a common axis of the cylindrical surfaces provided at each side of the refractory plate.

FIG. 5 on the other hand shows an embodiment in which the refractory plate 6 bears on cylindrical surfaces 25 (24) of the supporting beams 3 (2), by means of inclined flat surfaces 29 (28) of said refractory plate 6. In such embodiment, the refractory plate 6 will adjust its position in an oscillation-translation movement, with respect to its central position. The refractory plate 6 is provided with a steel envelope 30 protecting its free side, especially the lateral sides 25.

Figure 3:
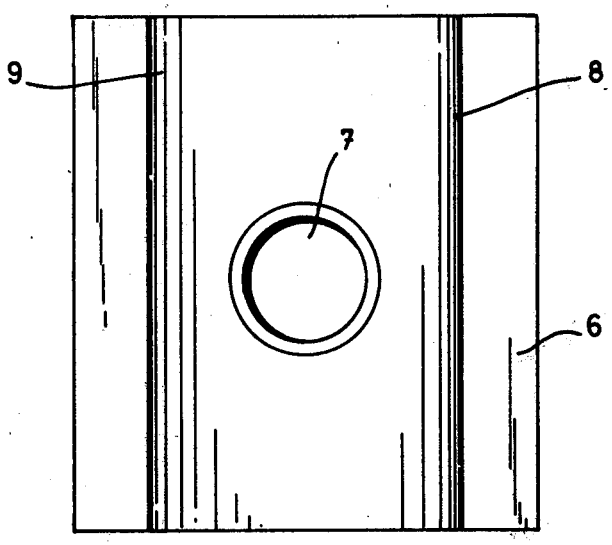
FIG. 3 is a bottom plan view of a refractory plate adapted to be used in the supporting arrangement according to FIGS. 1 and 2.

In each of the above embodiments of the invention the refractory plate is supported along the whole length of its lateral sides, either according to two pairs of cooperating longitudinal surfaces 4,5–8,9 (FIGS. 1 and 3), or respectively, according to two lines constituting the contact lines of the sliding surfaces 14,15 respectively 24,25 of the refractory plate 6, with the sliding surfaces 18,19 respectively 28,29 of the supporting beams 2,3 (FIGS. 4 and 5).

These arrangements of the supporting surfaces of the refractory plate allow for an appropriate distribution of the forces and avoid the risk of plate breakage due to punctual support at the extremities of the refractory plate.

Figure 6:
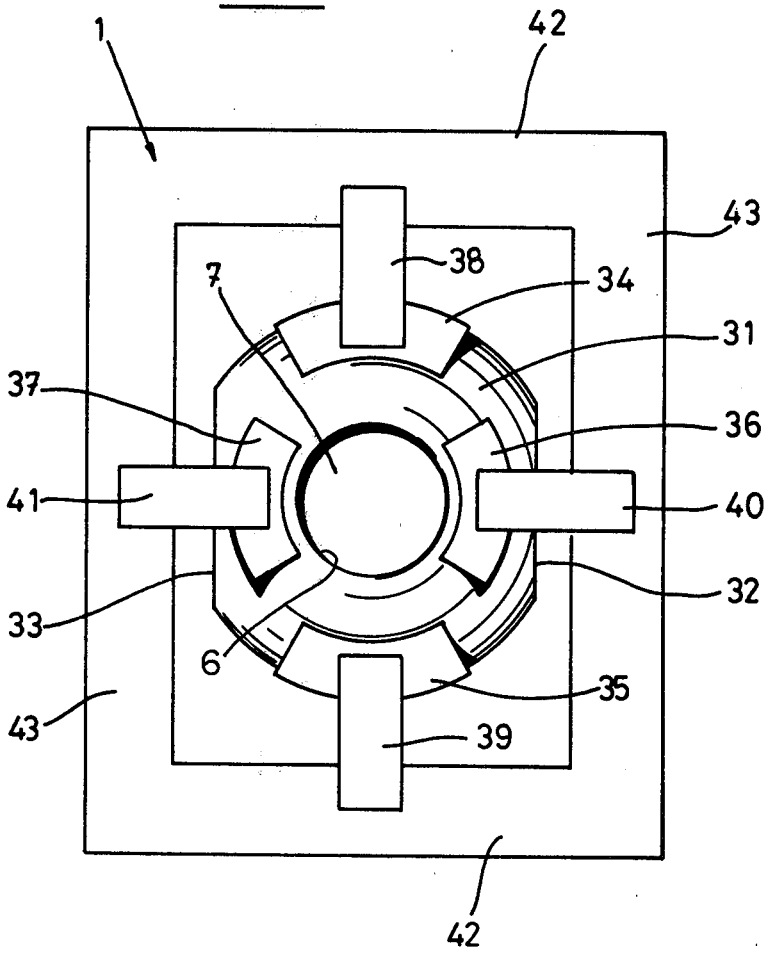
FIG. 6 is a bottom plan view, of a further embodiment of a supporting arrangement for a refractory plate, according to the invention.

Another embodiment of the invention, showing an arrangement in which the refactory plate 6 is supported through a kind of ball-joint bearing is represented in FIG. 6.

The refractory plate 6, having a pouring aperture 7, is shaped with a spherical sliding surface 31, having two parallely truncated side surfaces 32,33; this spherical sliding surface 31 bears upon two pairs of supporting surfaces 34,35 and 36,37 shaped as corresponding sphere segments and arranged at two different heights of the spherical sliding surface 31.

The supporting segments 34,35 and 36,37 are provided on supporting beams 38,39 and 40,41, which are provided to the smaller sides 42, respectively the longer sides 43 of a rectangular supporting frame 1.

In the embodiment of the invention shown in FIG. 6, the refractory plate 6 is supported on four bearing surfaces, appropriately arranged around the center of said plate, so that also in this embodiment the distribution of the forces will avoid the risk of plate breakage encountered with punctual support at the extremities of the refractory plate.

What I claim is:

1. An arrangement for supporting a refractory plate in a supporting frame of a slide gate of a pouring vessel, comprising: a seat defined on said supporting frame having at least two sliding bearing surfaces, and two corresponding sliding bearing surfaces defined on said refractory plate to form two pairs of sliding surfaces between the supporting frame and the refractory plate, at least one sliding surface of each pair having a curved shape to allow the refractory plate to freely oscillate with respect to the supporting frame.

2. Arrangement according to claim 1, in which the sliding surfaces of the seat of the supporting frame and the sliding surfaces of the refractory plate have both a curvature having substantially the same radius.

3. Arrangement according to claim 1, in which the sliding surfaces of the refractory plate have a curved shape and the sliding surfaces of the seat of the supporting frame have a flat shape.

4. Arrangement according to claim 1, in which the sliding surfaces of the refractory plate have a flat shape and the sliding surfaces of the seat of the supporting frame have a convex shape.

5. Arrangement according to claim 1, in which the refractory plate is shaped with said sliding surfaces along parallel lateral edges of a bottom surface thereof cooperating with said sliding surfaces of the supporting frame to allow the free oscillation of the refractory plate about a longitudinal axis corresponding to a direction of translation of said plate.

6. Arrangement according to claim 1, in which the refractory plate sliding surfaces have the shape of a portion of a cylinder which allows the refractory plate to freely oscillate about a longitudinal axis.

7. Arrangement according to claim 6, in which the sliding surfaces of the refractory plate are arranged according to a circumscribed cylinder.

8. Arrangement according to claim 1, in which the refractory plate sliding surfaces and the cooperating supporting frame sliding surfaces define a ball-joint seat allowing the refractory plate to freely oscillate in all directions.

9. Arrangement according to claim 1, in which the refractory plate is provided with a steel envelope protecting its free sides.

10. Arrangement according to claim 9, in which each sliding surface of the refractory plate consists of a portion of said steel envelope.

* * * * *